United States Patent [19]

Scordato et al.

[11] 4,164,870

[45] Aug. 21, 1979

[54] PIPETTES

[75] Inventors: Emil A. Scordato, Bronxville; Hugh W. Pratt, Pelham Manor, both of N.Y.

[73] Assignee: Medical Laboratory Automation, Inc., Mount Vernon, N.Y.

[21] Appl. No.: 895,127

[22] Filed: Apr. 10, 1978

[51] Int. Cl.[2] ..... B01L 3/02

[52] U.S. Cl. ..... 73/425.6

[58] Field of Search ..... 73/425.4 P, 425.6 R

[56] References Cited

U.S. PATENT DOCUMENTS

| | | | |
|---|---|---|---|
| 3,834,590 | 9/1974 | Robinson et al. | 73/425.6 |
| 3,933,048 | 1/1976 | Scordato | 73/425.6 |
| 3,935,734 | 2/1976 | Keegan | 73/425.6 |

*Primary Examiner*—S. Clement Swisher

*Attorney, Agent, or Firm*—William P. Keegan

[57] ABSTRACT

A fixed stroke pipette having a measuring piston that controls the volume of liquid aspirated into the pipette reservoir and a larger piston that assures the expulsion of all the aspirated liquid during a discharge stroke. An improved piston arrangement provides a fixed seal for the air chamber in which the measuring piston moves and a separate air passageway to that air chamber, controlled by a spring biased check valve, through which compressed air is delivered to the pipette reservoir during a discharge stroke.

13 Claims, 5 Drawing Figures

PIPETTES

FIELD OF THE INVENTION

The invention relates to pipettes, and more particularly to pipettes provided with special means to assure the discharge of the entire volume of liquid aspirated during the pipette filling operation.

BACKGROUND OF THE INVENTION

Manual pipettes of the type in which a piston is moved in a cylinder first in one direction to create a vacuum that enables a liquid to be aspirated into a reservoir and subsequently in the other direction to discharge the liquid are widely in use. The accuracy of such pipettes depends on the ability to aspirate a precise quantity of liquid and to discharge the liquid so that none remains in the pipette reservoir. Often this is difficult because of the formation of a droplet of liquid on the end of the reservoir when liquid is expelled therefrom. While the volume of the droplet may be small, it is to be noted that pipettes are used in transferring volumes measured in microliters, as small as five microliters, and the volume of a droplet may be an appreciable part of the total volume aspirated into the reservoir. In such case, the accuracy of the pipette is severly impaired if the droplet is not transferred with the balance of the aspirated liquid.

This has been recognized in the art and several means have been provided to deal with the problem of droplets remaining in the pipette reservoir. Attention is particularly directed to those pipettes which may be referred to as overblow pipettes. Such pipettes employ a first piston that controls the quantity of liquid aspirated into the pipette reservoir, and a second larger piston that compresses a relatively large volume of air that is then admitted to the reservoir to blow any remaining droplets out of the reservoir and into the receiving vessel at the completion of the discharge stroke. U.S. Pat. Nos. 3,834,590, 3,933,048, and 3,935,734 disclose pipettes of the type to which reference is made.

BRIEF DESCRIPTION OF THE INVENTION

It is the object of the present invention to provide an improved overblow pipette.

In carrying out the invention there is provided an overblow pipette having an improved fixed stroke piston means that enables the measuring piston to reciprocate past a fixed sealing member that assures the accuracy of the quantity of liquid aspirated and to provide a separate passageway for the compressed air to reach the pipette reservoir. Specifically, the measuring piston and the overblow piston form an integral piston means and the compressed air passageway is internal to the piston means and is normally closed by a spring biased poppet valve.

Features and advantages of the invention may be gained from the foregoing and from the description of a preferred embodiment of the invention that follows.

DETAILED DESCRIPTION OF THE INVENTION

Figure 1:
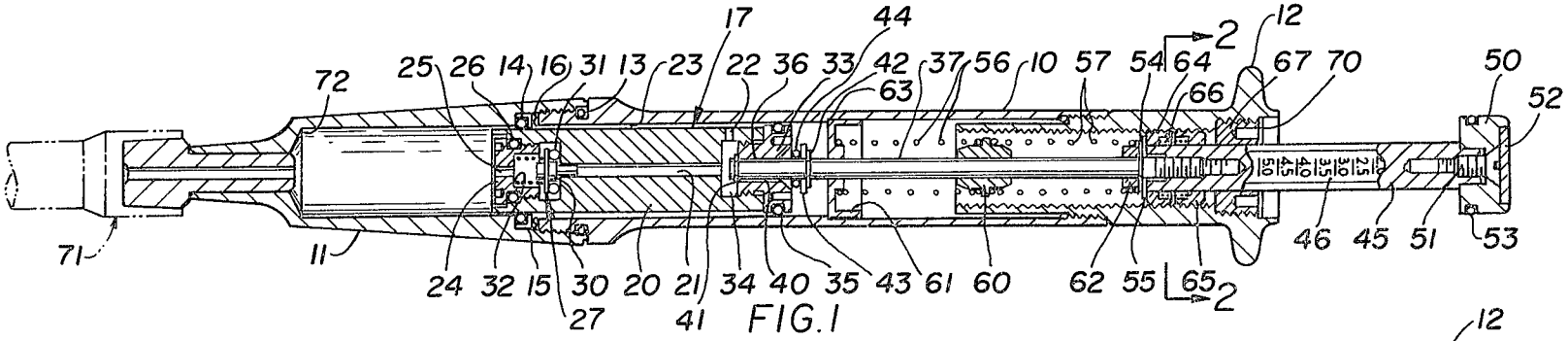
FIG. 1 is a side elevational view, in section, of a pipette embodying the invention.

Reference is now made to FIG. 1 wherein a cylindrical tubular barrel 10 is shown provided with a nozzle member 11 at its forward end and a bonnet member 12 at its other end. These latter members are threaded onto barrel 10. The connecting end of nozzle member 11 is internally threaded to cooperate with the external thread provided on barrel 10, while bonnet member 12 is externally threaded for connection to the internal thread provided at that end of the barrel. Bonnet 12 has a central bore that is threaded, preferably with a multilead thread, for a purpose that later will be disclosed.

An O-ring piston seal 13 is provided as shown at the forward end of barrel 10 so that the threaded connection between the barrel and nozzle member 11 becomes air-tight when the two parts are threaded together. Moreover, a metering piston seal 14 is mounted between the end face of barrel 10 and a shoulder formed on the internal bore in nozzle member 11. A flanged washer 15 and a wave washer 16 are provided as shown.

A piston 17 is provided for longitudinal movement within barrel 10 and the bore of nozzle member 11. The piston 17 comprises a main body 20 that is provided with an air passageway 21 and a radial aperture 22 leading from passageway 21 to the outer peripheral surface of piston 17. It will be observed that piston 17 is smaller in diameter than the bore of barrel 10 so that an annular air chamber 23 surrounds the piston. However, the fit of piston 17 and seal 14 is air-tight. The forward end of piston body 20 is machined and threaded a shown to accommodate a fitting 24. The fitting is provided with an aperture 25 and an O-ring 26, the latter to make the threaded connection between fitting 24 and piston body 20 air-tight. The arrangement is such that a small chamber is formed between air passageway 21 and aperture 25, and a poppet valve 27 is provided within the chamber to prevent the passage of air from passageway 21 to aperture 25 except as will be hereinafter described. The poppet valve comprises a flanged member 30, an O-ring 31, and a compression spring 32 that biases member 30 and O-ring 31 into a sealing position against the face of piston body 20. The opposite end of piston body 20 is similarly machined to accommodate overblow fitting 33. When threaded into main body 20 of piston 17, an air plenum is formed between aperture 22 and air passageway 21. An O-ring 35 is provided on fitting 33 and it engages the internal surface of barrel 10 in an air-tight relationship. An oversized central aperture 36 is provided in fitting 33 through which piston rod 37 loosely fits. The arrangement is such that an annular air passageway 40 is provided. The piston rod 37 extends through fitting 33 into plenum 34 where a snap washer 41 is placed in a circumferential groove in the rod. A short distance from washer 41 is a second snap washer 42 fitted into another circumferential groove, a bearing washer 43 and an O-ring 44. The spacing between washers 41 and 42 is such that when washer 41 is abutting fitting 33, washers 42 and 43 and O-ring 44 will be spaced from fitting 33 to permit air to leak through annular passageway 40, plenum 34, and aperture 22 into air chamber 23.

Piston rod 37 is press fitted into the stem member 45. Member 45 is a cylindrical member having at least one flattened surface 46 on which a pipette capacity scale 47 is engraved or otherwise marked. At its distal end, a thumb knob 50 is secured to member 45 by a screw 51, and a plastic disk 52 is placed in the depression formed in knob to accommodate screw 51. The O-ring 53 serves only a decorative purpose.

Where piston rod 37 enters stem 45, a snap washer 54 is fitted into a groove provided on the rod and a bearing washer 55 is placed between the snap washer 54 and the end of stem 45. A pair of compression springs 56 and 57, separated by a spacer member 60 extend between the annular channel member 61 and bearing member 62 which abuts snap washer with a force exerted by springs 56 and 57. The position of member 61 is determined by the shoulder 63 formed on the internal surface of barrel 10. It will be clear that springs 56 and 57 urge piston rod 37 into the position illustrated in the drawing with washer 41 in engagement with fitting 33 of piston 17 and washer 55 in abutment with the volume adjustment nut 64.

Figure 2:
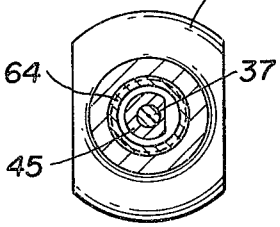
FIG. 2 is a sectional view taken along line 2—2 of FIG. 1.

Nut 64 and a second adjustment nut 65, each having a flattened aperture (see FIG. 2) to conform to the flattened surface of stem 45, are fitted over stem 45 and threaded into bonnet member 12. The outer surfaces of both nuts 64 and 65 are provided with the same thread, preferably a multi-lead thread, as the bore of bonnet member 12. The arrangement is such that as stem 45 is rotated, the adjustment nuts 64 and 65 advance or withdraw along the thread of the bonnet member. Thus, the spring biased position of piston 17 is determined by the position of the adjustment nuts 64 and 65. A spring 66 is provided between nuts 64 and 65 to bias them into frictional engagement with the thread of the bonnet member and thereby tend to keep the nuts in their adjusted position. A cap nut 67, having a circular bore in which stem 45 can rotate, is provided to close the large bore in bonnet member 12 through which the internal parts of the pipette are inserted into barrel 10.

Figure 3:
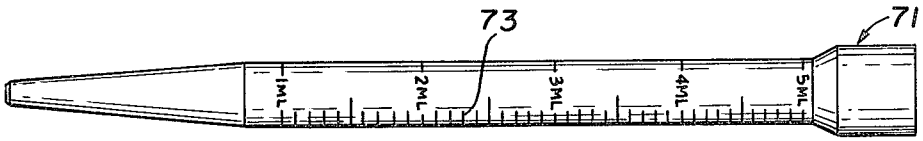
FIG. 3 is an elevational view of a calibrated pipette reservoir used for calibrating the pipette of FIG. 1.

In operation, stem 45 will be rotated until the numerical indication on scale 47 corresponding to the volume in milliliters to be pipetted is aligned with the surface 70 of cap nut 67. Thereupon, a calibrated pipette reservoir 71 (see FIG. 3) is wedged onto the end of nozzle member 11 in an air-tight connection. The parts of the pipette will be as illustrated in the drawing. The pipette to the right of piston 17 is not air-tight so air will enter the barrel through bonnet member 12 and pass through passageway 40 into the annular air chamber 23. An aperture can be provided in the wall of barrel 10 to the right of the farthest right adjusted position of piston 17 if desired. Pressure will be applied to thumb knob 50 against the force exerted by springs 56 and 57, and initially piston 17 will not move because rod 37 fits loosely through fitting 33 and O-ring 44 is not abutting fitting 33. When O-ring 44 engages fitting 33 it seals passageway 40 and moves piston 17 to expel air from nozzle member 11 and calibrated reservoir 71. Pressure on thimb knob 50 will be continued until the front edge of piston 17 engages shoulder 72 of nozzle member 11. Air in annular chamber 23 is compressed when piston 17 is advanced, and when it reaches a certain pressure it opens poppet valve 27, but on the stroke just described this action is of no significance. Suffice it to say, that when piston 17 strikes shoulder 72, poppet valve 27 is closed.

With piston 17 fully depressed, i.e., in engagement with shoulder 72, the tip of reservoir 71 is inserted into the fluid to be pipetted. Thumb pressure is released from knob 50 and piston 17 moves to its normal position under the influence of springs 56 and 57. Movement continues until washer 55 strikes adjustment nut 64. A volume of liquid will have been drawn into reservoir 71 determined by the longitudinal movement, or stroke, of piston 17 and the face area of the piston. With the tip of reservoir 71 still in the liquid, the precise quantity of liquid in the reservoir, as determined by the markings 73 on the calibrated reservoir, can be adjusted by rotating stem 45 until the level of the liquid in the reservoir is brought into alignment with the desired marking thereon. The stem can be rotated in either direction depending on whether it is desired to have more or less liquid in the reservoir.

Now, the pipette is moved to withdraw the reservoir from the liquid and bring it to the receptacle into which the measured quantity of liquid is to be discharged. As described before, with the pipette parts in the now assumed position, which is that illustrated in the drawing, air will flow freely into annular air chamber 23. After the first incremental movement of piston rod 37 on its downward stroke, O-ring 44 engages fitting 33 to seal air chamber 23 and thereafter move piston 17 downwardly to expel the liquid in reservoir 71. During downward movement of the overblow O-ring 35 air is being compressed in chamber 23. Near the end of the stroke when most of the liquid has been expelled from the reservoir by the movement of piston 17, the air pressure in chamber 23 will be sufficient to open valve 27 and allow the compressed air to exit from air chamber 23 through aperture 22, passageways 21 and 25 in piston 17, and nozzle member 11 to blow any liquid droplets remaining in the reservoir out of the reservoir.

Figure 4:
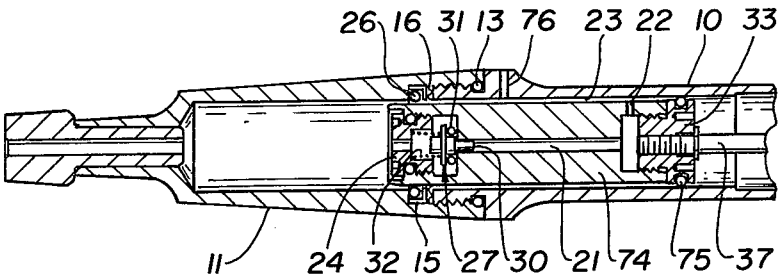
FIG. 4 is a fragmentary side elevational view, in section, showing another embodiment of the invention.

In another embodiment of the invention, the pipette is essentially the same as illustrated in FIG. 1 except that piston 17 and barrel 10 are slightly modified. FIG. 4 illustrates the modification; those parts not being shown being the same as in FIG. 1. Here piston rod 37 is press fitted into piston body 74 and O-ring 75 is mounted directly on piston body 74. Thus, annular air chamber 23 is completely sealed except for aperture 76 in the wall of barrel 10, which aperture allows air to enter chamber 23 when the pipette is in its normal position. When piston rod 37 is depressed to discharge liquid from the reservoir as before, piston 17 immediately moves since there is no free play between piston rod 37 and the piston. When rod 37 moves piston 17 far enough that O-ring 75 passes aperture 76, air chamber 23 becomes sealed and the air therein begins to undergo compression. Further movement of the piston raises the air pressure in chamber 23 to the point where it opens poppet valve 27 thereby allowing the air to enter reservoir 71 and blow any remaining droplets out of the reservoir. It is clear that if the arrangement of the present embodiment is used in a pipette having a wide range of volumetric adjustment, the aperture 76 in barrel 10 must be located to be in communication with air chamber 23 even for the smallest volume adjustment when the pipette is in its normal positon.

Figure 5:
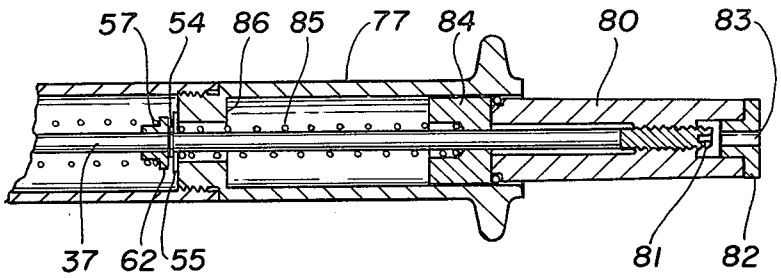
FIG. 5 is a fragmentary sectional view showing another piston stroke control mechanism.

The pipette hereinabove described in connection with the FIG. 1 embodiment makes use of a piston stroke controlling mechanism that permits a wide range of adjustment, and so the pipette may be termed an adjustable multi-volume pipette. The same overblow principle can be utilized in a single volume pipette in which a different stroke control mechanism may be employed. Attention is directed to FIG. 5 in which another calibrateable stroke control mechanism is shown. The parts of the pipette not shown in FIG. 5, will be the same as those shown in FIG. 1 or FIG. 4. Since the latter figure, i.e., FIG. 4, shows a simpler overblow mechanism, it might be preferred in a single volume pipette. FIG. 5 shows a bonnet member 77 threaded into barrel 10 and having a smooth bore through which piston rod 37 projects. Rod 37 is threaded into thumb knob 80 and is provided with an allen socket 81 at its end. Thumb knob 80 has an end cap 82 press fitted thereon, and the end cap has a central aperture through which an allen wrench may be passed for insertion in socket 81. The arrangement permits piston rod 37 to be held fast and thumb knob 80 rotated so as to move in either direction along rod 37. A volume control cylinder 84 is placed on rod 37 and it is biased into engagement with the end of knob 80 by a spring 85. The remote end of the spring bears against washer 55. It is clear that in the present embodiment, the return stroke position of rod 37 is determined by the engagement of washer 55 with the end face 86 of bonnet 77. The discharge stroke position of rod 37 is determined by the engagement of cylinder 84 with the shoulder 86 of bonnet 77. The length of the stroke, and hence the volume of liquid drawn into a calibrated reservoir, may be calibrated by adjusting the position of thumb knob 80 on rod 37 as hereinabove described. Since the FIG. 5 stroke control mechanism is presferred for a single volume calibratable pipette, the liquid reservoir may, instead of the full range of markings shown in the FIG. 3 reservoir, have only a single reference mark to which the liquid level is aligned.

Having thus described the invention, it is clear that many apparently widely different embodiments thereof could be provided without departing from its spirit and scope. In this connection it should be noted that the drawing is illustrative and is not intended to indicate the relative dimension of parts. For example, in a very small volume pipette, e.g., a five microliter pipette, the measuring piston may be a hypodermic needle. Thus, a hypodermic needle might be fitted into aperture 25 of fitting 24 and extend through the narrowed aperture 87 in nozzle member 11. In such case, an air-tight seal between the needle and the interior of nozzle member 11 would be provided. Therefore, it is intended that the specification and the drawing be interpreted as illustrative rather than in a limiting sense.

What is claimed is:

1. A pipette comprising: barrel means having a nozzle end; piston means reciprocably movable in said barrel means, the periphery of said piston means being spaced from the internal wall of said barrel means to provide an air space around said piston means, said piston means being provided with an internal air passageway leading from said peripheral air space to the end of said piston means facing the nozzle end of said barrel means; valve means for closing said air passageway; first sealing means mounted on the end of said piston means remote from the nozzle end of said barrel means to provide an air-tight seal between said piston means and the internal wall of said barrel means, said first sealing means defining one end of an air chamber that includes the peripheral air space around said piston means; second sealing means mounted in said barrel means to cooperate with the end of said piston means proximate to the nozzle end of said barrel means and provide an air-tight seal between said piston means and said barrel means, said second sealing means defining a second end of the aforesaid air chamber; means connected to said piston means for reciprocating said piston means and said first sealing means within said barrel means between a first and a second limiting position; and an air air vent through the wall of said barrel means from said air chamber to the exterior of said barrel means, said air vent being located between said first and said second sealing means when said piston means is in its first limiting position, and being further located so that when said piston means is moved from its first to its second limiting position said first sealing means traverses the air vent to seal the aforesaid air chamber and thereafter compress the air therein.

2. A pipette according to claim 1 wherein said valve means comprises a spring biased poppet valve, and including spring means for biasing said connecting means and said piston means to the first limiting position.

3. A pipette according to claim 2 including an adjustably positioned stop member that determines the first limiting position, and means mounted on said connecting means for abutting said stop member.

4. A pipette according to claim 3 wherein said barrel means is internally threaded at the end thereof opposite the nozzle end and said stop member is externally threaded for engagement with the barrel means thread, said stop member having a central aperture through which said connecting means can slide but which cooperates with said connecting means such that rotation of said connecting means moves said stop means along the threads of said barrel means.

5. A pipette according to claim 1 wherein said piston means includes hollow needle means.

6. A pipette according to claim 1 wherein said barrel means includes a first shoulder means that determines the first limiting position and a second shoulder means that determines the second limiting position, and including first stop means mounted on said connecting means, spring means for biasing said first stop means into abutting relationship with said first shoulder means, and second stop means adjustably positioned on said connecting means for engagement with said second shoulder means.

7. A pipette according to claim 4 wherein the internal thread on said barrel means and the external thread on said stop member are multi-lead threads, and including a calibrated reservoir mounted on the nozzle end of said barrel means for setting the position of said stop member in accordance with the liquid level in said calibrated reservoir.

8. A pipette comprising: barrel means having a nozzle end; piston means reciprocably movable in said barrel means, the periphery of said piston means being spaced from the internal wall of said barrel means to provide an air space around said piston means, said piston means being provided with an internal air passageway leading from said peripheral air space to the end of said piston means facing the nozzle end of said barrel means, said piston means being further provided with an axial bore leading from said air passageway to the remote end of said piston means; valve means for closing said air passageway; first sealing means mounted on the end of said piston means remote from the nozzle end of said barrel means to provide an air-tight seal between said piston means and the internal wall of said barrel means, said first sealing means defining one end of an air chamber that includes the peripheral air space around said piston means; second sealing means mounted in said barrel means to cooperate with the end of said piston means proximate to the nozzle end of said barrel means and provide an air-tight seal between said piston means and said barrel means, said second sealing means defining a second end of the aforesaid air chamber; and means for reciprocating said piston means and said first sealing means in said barrel means between a first and a second limiting position, said means including a piston rod extending through the bore in said piston means with sufficient peripheral clearance to provide a second air passageway from said air chamber to the remote end of said piston means, and a sealing means carried by said piston rod and adapted to close said second air passageway when said piston rod is actuated to move said piston means from its first to its second limiting position whereby further movement of said piston means compresses air in the aforesaid air chamber.

9. A pipette according to claim 8 wherein said value means comprises a spring biased poppet valve, and including spring means for biasing said piston rod and said piston means to the first limiting position.

10. A pipette according to claim 9 including an adjustably positioned stop member that determines the first limiting position, and means mounted on said piston rod for abutting said stop member.

11. A pipette according to claim 10 wherein said barrel means is internally threaded at the end thereof opposite the nozzle end and said stop member is externally threaded for engagement with the barrel means thread, said stop member having a central aperture through which said piston rod can slide but which cooperates with said piston rod such that rotation of said piston rod moves said stop member along the threads of said barrel means.

12. A pipette according to claim 8 wherein said barrel means includes a first shoulder means that determines the first limiting position and a second shoulder means that determines the second limiting position, and including first stop means mounted on said piston rod, spring means for biasing said first stop means into abutting relationship with said first shoulder means, and second stop means adjustably positioned on said piston rod for engagement with said second shoulder means.

13. A pipette according to claim 11 wherein the internal thread on said barrel means and the external thread on said stop member are multi-lead threads, and including a calibrated reservoir mounted on the nozzle end of said barrel means for setting the position of said stop member in accordance with the liquid level in said calibrated reservoir.

* * * * *